US009061404B2

(12) United States Patent
Dohogne

(10) Patent No.: US 9,061,404 B2
(45) Date of Patent: Jun. 23, 2015

(54) RATCHET MECHANISM

(71) Applicant: Dennis A. Dohogne, St. Johns, FL (US)

(72) Inventor: Dennis A. Dohogne, St. Johns, FL (US)

(73) Assignee: IL7!, LLC, St. James, FL (US)

( * ) Notice: Subject to any disclaimer, the term of this patent is extended or adjusted under 35 U.S.C. 154(b) by 298 days.

(21) Appl. No.: 13/862,550

(22) Filed: Apr. 15, 2013

(65) Prior Publication Data

US 2014/0305264 A1 Oct. 16, 2014

(51) Int. Cl.
*B25B 21/00* (2006.01)
*B25B 13/46* (2006.01)

(52) U.S. Cl.
CPC ..... *B25B 21/004* (2013.01); *B25B 13/467* (2013.01)

(58) Field of Classification Search
CPC .... B25B 13/46; B25B 13/463; B25B 13/467; B25B 13/468; B25B 13/481; B25B 21/004; B25B 17/00
USPC ..... 81/57, 57.14, 57.3, 57.39, 57.42
See application file for complete search history.

(56) References Cited

U.S. PATENT DOCUMENTS

| | | | | |
|---|---|---|---|---|
| 1,078,059 | A | 11/1913 | Mossberg | |
| 2,491,624 | A | 12/1949 | Shaff | |
| 2,712,256 | A | 7/1955 | Fish | |
| 4,211,127 | A | 7/1980 | D'Oporto et al. | |
| 4,409,865 | A | 10/1983 | Krautter et al. | |
| 4,480,510 | A | 11/1984 | Aparicio, Jr. et al. | |
| 4,644,829 | A | 2/1987 | Junkers | |
| 4,919,022 | A | 4/1990 | Ono et al. | |
| 4,974,475 | A | 12/1990 | Lord et al. | |
| 5,029,497 | A | 7/1991 | Junkers | |
| 5,058,463 | A | 10/1991 | Wannop | |
| 5,522,287 | A | 6/1996 | Chiang | |
| 5,535,646 | A | 7/1996 | Allen et al. | |
| 5,622,089 | A | 4/1997 | Gifford, Sr. | |
| 5,913,954 | A | 6/1999 | Arnold et al. | |
| 5,957,009 | A | 9/1999 | McCaan | |
| 6,093,128 | A | 7/2000 | Seith | |
| 6,161,454 | A | 12/2000 | Chaconas | |
| 6,298,752 | B1 | 10/2001 | Junkers | |
| 6,330,842 | B1 | 12/2001 | Brun | |
| 6,427,559 | B2 | 8/2002 | Junkers | |
| 6,457,386 | B1 | 10/2002 | Chiang | |
| 6,490,953 | B2 | 12/2002 | Horvath | |
| 6,543,316 | B2 | 4/2003 | Daigle et al. | |
| 6,578,643 | B2 | 6/2003 | Izumisawa | |
| 6,640,669 | B2 | 11/2003 | Izumisawa | |
| 6,789,447 | B1 | 9/2004 | Zinck | |
| 6,860,174 | B2 | 3/2005 | Kusama | |
| 6,915,721 | B2 | 7/2005 | Hsu et al. | |
| 6,918,477 | B2 | 7/2005 | Tuanmu | |
| 6,923,095 | B2 | 8/2005 | Horvath | |
| 7,059,217 | B2 | 6/2006 | Horvath | |
| 7,062,992 | B2 | 6/2006 | Spirer | |
| 7,121,167 | B1 | 10/2006 | Miner | |
| 7,836,797 | B2 | 11/2010 | Hecht et al. | |
| 7,886,840 | B2 | 2/2011 | Young et al. | |
| 8,051,746 | B2 | 11/2011 | Bouchard et al. | |
| 8,757,031 | B2 * | 6/2014 | Su | 81/57.39 |

(Continued)

*Primary Examiner* — Hadi Shakeri
(74) *Attorney, Agent, or Firm* — Thomas C. Saitta

(57) ABSTRACT

A ratchet mechanism having a plurality of interconnected rotating drive members having teeth, one of the drive members being a stationary drive member and another of the drive members being a movable intermediate drive member, a first pawl member and a second pawl member movable in alternating reciprocating manner, wherein the stationary drive member is alternatingly rotated in a single direction by movement of the pawl members.

20 Claims, 9 Drawing Sheets

(56) References Cited

U.S. PATENT DOCUMENTS

| | | | | |
|---|---|---|---|---|
| 8,844,408 | B2 * | 9/2014 | Chen | 81/57.39 |
| 2003/0024715 | A1 * | 2/2003 | Izumisawa | 173/104 |
| 2004/0244544 | A1 | 12/2004 | Hsien | |
| 2012/0186400 | A1 | 7/2012 | Elger | |
| 2012/0234139 | A1 | 9/2012 | Chen | |
| 2013/0025416 | A1 * | 1/2013 | Dedrickson et al. | 81/57 |

* cited by examiner

RATCHET MECHANISM

BACKGROUND OF THE INVENTION

The invention generally relates to a mechanism incorporated into a handheld power tool that increases functionality or ease of usage. Principally, the invention relates to handheld ratchets driven by pneumatic, electric, hydraulic or manual power sources. More predominantly, this invention relates to a device that applies torque to a rotary fastener to tighten or loosen or otherwise adjust it by turning. In particular, the device utilizes a plurality of toothed engagements to more rapidly impart this torque.

Ratchets are generally known and used as handheld power tools in a wide variety of industries such as automotive repair and manufacturing operations. Ratchets are often energized by pneumatic motors or electric motors powered via line voltage or by way of battery. Increasing the output speed or torque of such ratchets and/or reducing the size of such ratchets will result in several benefits to society.

This invention generally relates to ratchet drive wrenches and more particularly to a powered ratchet drive wrench having a plurality of toothed members for both utilizing the full output of a drive transmission to achieve higher operating speeds of the output member and inhibiting counter-rotation of the output member.

The invention is especially concerned with a powered wrench that rotates an output member with an attached socket for turning a fastener element such as a bolt or a nut. Wrenches of this type are useful in automotive repair and industrial applications. Conventionally, pneumatic or air ratchet drive wrenches comprise an air motor for powering the wrench, an internal ratchet mechanism for transferring motion of the motor and an output member for transmitting such motion to a work piece. Put simply, the internal ratchet mechanism typically includes a rotating offset shaft spinning proportionately with the air motor that in turn pivots a rocker having pawls attached which repeatedly engage sets of teeth on intermediate toothed members which subsequently engage the output member, causing the member to rotate in a desired direction. During each rotation of the air motor, the output member is rotated a fraction of a revolution. By repeatedly engaging the output member and rotating it only a short distance, great mechanical advantage is obtained and the high-speed rotation of the air motor is readily converted to a high-torque, yet more slowly rotating, output member. Instead of a pneumatic motor an electric motor powered by line voltage through a cord or a cordless motor powered by batteries or any other type of motor may be used to drive the ratchet mechanism. These advantages are well understood in the relevant art.

Despite the simplicity of the concept behind a powered ratchet drive wrench, the internal ratchet mechanisms of conventional powered ratchet drive wrenches are complex and require many parts interacting with one another. For instance, wrenches traditionally require complex mechanisms for ensuring that the output member of the wrench does not rotate counter the desired direction during wrench use. These mechanisms often include multiple parts that serve the limited purpose of inhibiting counter-rotation of the output member. Similarly, size and space limitations of the wrench often compel the fashioning of elaborate, interactive components. Simplification of such a wrench by eliminating redundant parts and reducing the size and complexity of required parts improves overall wrench design.

Current ratchet wrench designs utilize only half the output of the transmission drive between the ratchet mechanism and the driving force, whether that be from a motor or by hand action. The output member incrementally rotates a few degrees, performing the desired work, during the power stroke half of the transmission drive output. During the other half of the output of the transmission drive the mechanism is "ratcheting" where the output member is stationary and the driving pawl slips out of engagement during a retracting motion. In the case of a motor-driven ratchet mechanism the transmission driving the ratchet mechanism still has power available to drive the output member against its resistance of the fastener, but it is effectively disengaged due to the retracting motion of the pawls and the subsequent disengaging ratchet action. Utilization of this wasted power improves the overall wrench effectiveness by increasing the amount of work accomplished.

It is an aim of wrench manufacturers to provide a power driven wrench that uses energy efficiently. One difficulty in the fashioning of such a wrench is providing an output member that may rotate in both directions, yet will not rotate opposite the desired direction during the requisite ratcheting retraction stroke between subsequent pawl engagements.

Non-continuous drive ratchets need a means to prevent counter-rotation and they all employ special parts solely for this purpose. Most, if not all, of these counter-rotation devices employ a method to create a frictional drag sufficient enough to prevent counter-rotation. However, this drag is a frictional force that resists motion and is always present, even when counter-rotation is not needed and the pawl is driving the output member. Thus, some of the tool's output is diminished by having to overcome this parasitic friction. Typically, those wrenches include frictional pressure washers for impeding counter-rotation of the output member, while other configurations incorporate stop mechanisms of increased complexity and cost. The invention at hand does not incorporate any components whose sole purpose is to provide the counter-rotation function. The design inherently achieves the counter-rotation necessary by continuously driving the output member.

The invention at hand manages energy more efficiently by utilizing the otherwise wasted retraction-only motion of the transmission drive, thus doubling the effective of the output drive member.

SUMMARY OF THE INVENTION

Among the several objects and features of the present invention may be noted the provision of a ratchet drive wrench which utilizes the full power output of the driving transmission, whether powered pneumatically, hydraulically, electrically or otherwise; the provision of such a wrench which allows for a smaller overall wrench size for access into small spaces; the provision of such a wrench which allows for a suitable balance of output speed, torque and size such that power ratchets, particularly cordless battery powered tools, are more viable; and the provision of such a wrench which may be manufactured inexpensively.

Generally, a pneumatic version of the ratchet drive wrench of the present invention may be described as follows. An air inlet is supported by a housing. The inlet is sized and shaped for connection to a source of pressurized air. An air motor is disposed in the housing and is in fluid communication with the air inlet for receiving pressurized air. The motor includes a rotatable drive shaft that rotates when pressurized air passes through the motor. A transmission is mechanically connected to the output of the motor within the housing and the input of a rocker mechanism. The transmission generally converts the high speed, low torque of the motor to a lower speed, higher torque input to the rocker. A rocker is disposed pivotally within the housing and is operatively connected to the transmission output drive shaft so that rotation of the drive shaft induces oscillation of the rocker.

A pair of pawls are pivotally attached to the rocker. At least one toothed movable intermediate drive member, e.g., a gear, is retained in the housing between the pawls and is selectively engaged with one of the pawls. An additional toothed drive member, e.g., a gear, is mounted in the housing for rotation about its longitudinal axis, this drive member being stationary in that the rotational axis does not shift relative to the housing, and is configured as the output member. The stationary drive member comprises a protrusion, typically square in cross-section, that projects from the housing for transmitting torque to a socket mounted thereon or directly to an object. This square protrusion is commonly referred to as an anvil. Each pawl is shaped and sized for engagement with the teeth of either an intermediate drive member or the stationary drive member. Each pawl may have a single extended toothed engagement section with proximal and distal segments or two separate toothed engagement sections, a proximal segment to engage the movable intermediate drive member and a distal segment for either the stationary drive member or another toothed intermediate drive member. The proximal and distal toothed engagement segments of the pawl may be provided in a linear or curvilinear segment, or may be provided as distinct and separate segments. The movable intermediate drive member is rotatably engaged with the stationary drive member, directly by contact or indirectly through one or more additional intermediate drive members, such that rotation of the movable intermediate drive member results in rotation of the output member.

A reversing mechanism assembly is retained by the housing such that the rotation of the stationary drive member may be chosen to be clockwise or counterclockwise. At least one reversing lever, knob, button, slide or the like is positioned externally to the housing and/or cover plate and is mechanically connected, preferably removably, to the interior components of the reversing mechanism to impart motion to the interior components of the reversing mechanism. The reversing mechanism assembly consists of at least one reversing arm or link that is sized and shaped to retain the movable intermediate drive member. The movable intermediate drive member is free to rotate with respect to the reversing arm. The reversing mechanism is sized and shaped to cause the movable intermediate drive member to move into engagement with one or the other of the pawls. The reversing mechanism is sized and shaped to cause the movable intermediate drive member to maintain direct or indirect engagement with the stationary drive member.

The output motion of the transmission causes the rocker to oscillate. The rocker causes each pawl to oscillate in a generally forward and back motion in an alternating manner. One movement direction defines an engaged or driving stroke direction while the opposite direction defines a disengaged or neutral direction. During movement of a pawl in the engaged direction one of the toothed segments is engaged directly with either the stationary drive member, a stationary intermediate drive member or a movable intermediate drive member and causes it to rotate to produce the desired output rotation. During the movement of a pawl in the disengaged direction the previously engaged toothed segment is disengaged from the engaged stationary drive member, stationary intermediate drive member or movable intermediate drive member. The other pawl is now moving in the engaged direction and its toothed segment engages one of the previously non-engaged stationary drive member, stationary intermediate drive member or movable intermediate drive member, resulting in rotation of the stationary drive member in the same direction as before because of the relationship between the stationary drive member and the intermediate drive member or members. Thus the present invention converts the full oscillation of the rocker into the desired output motion of the stationary drive member with only a momentary pause when the rocker reverses direction. At least one spring is supported in the housing to urge each of the pawls to re-engage with the appropriate drive member as the pawls complete their disengaged strokes and begin their engaged strokes.

Ratchets are often used in very confined spaces such as deep inside automotive engine compartments. Since the user can configure the tool to have a reverse lever on the housing side, the cover plate side, or both, the reverse levers being removable, they have considerably more utility with this tool in that the reverse lever is more accessible by either being on both sides or by being on the side of the tool where there is better access for their given circumstances, or the reverse lever or levers can be removed completely to streamline the tool for access into restricted spaces.

Further on the subject of advantages, the design of this ratchet yields twice the driving impulses of a conventional intermittent motion ratchet. Thus this ratchet invention has twice the efficiency of conventional intermittent motion ratchets. The ratchet can therefore be so sized as to provide the same speed and torque of a conventional power ratchet, but with a smaller motor and drive system. Alternatively, with the same size motor and drive system the output can be designed to provide the same speed, but twice the torque, or the same torque, but twice the speed.

A further advantage of this invention is the greater access to the confined spaces within which such ratchets are typically used. By virtue of its small and smooth head design and further with its reverse actuator remotely located from the output member the tool is better suited to tight spaces and less prone to snagging on wires, belts and hoses typically encountered in tight engine compartments.

Other objects and features will be in part apparent and in part pointed out hereinafter.

DETAILED DESCRIPTION

Figure 1:
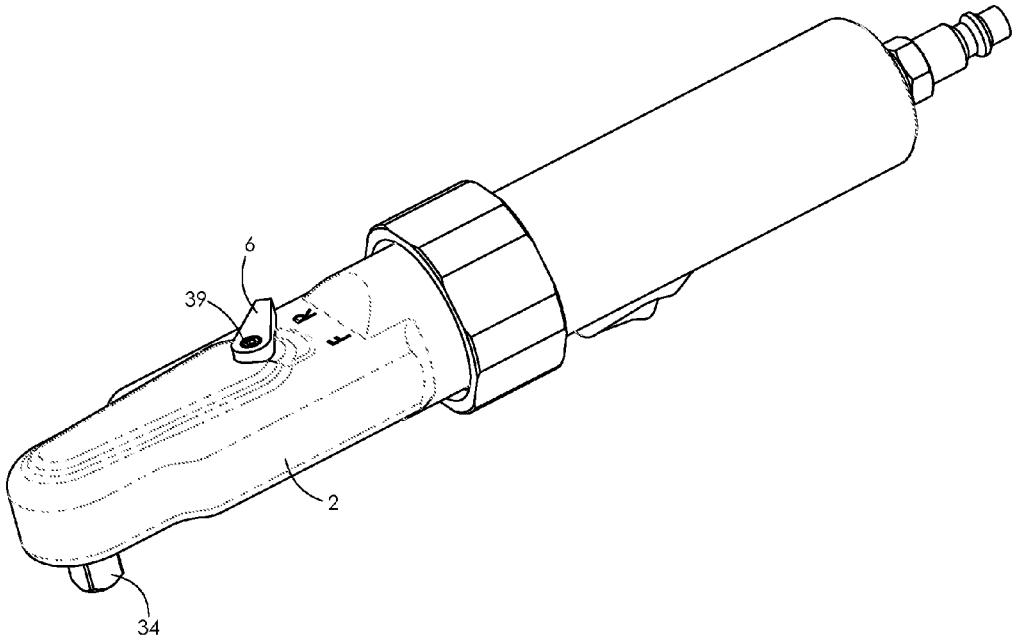
FIG. 1 is a perspective view of an embodiment of the invention, the embodiment comprising three intermediate drive members.
Figure 2:
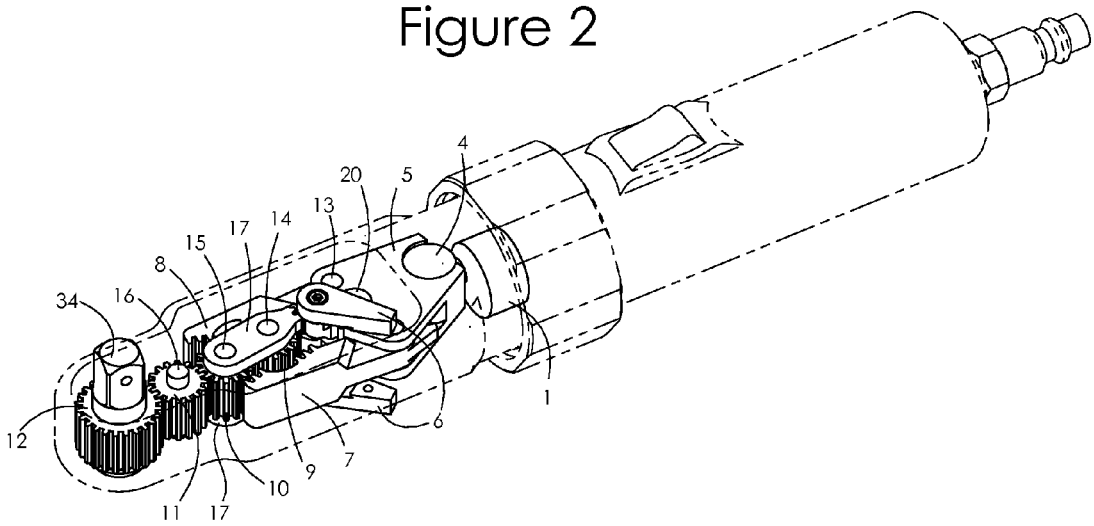
FIG. 2 is a perspective view of the opposite side of the embodiment of FIG. 1 with the exterior components shown in phantom to expose interior details.
Figure 3:
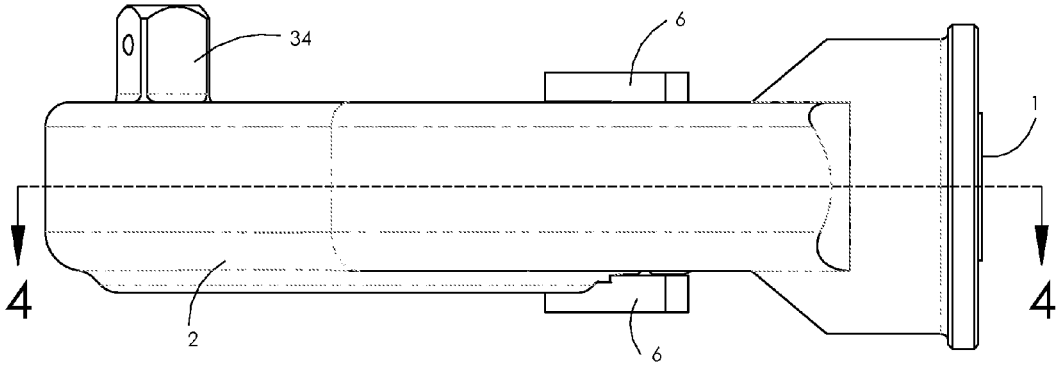
FIG. 3 is a side view of the embodiment of FIG. 1.
Figure 4:
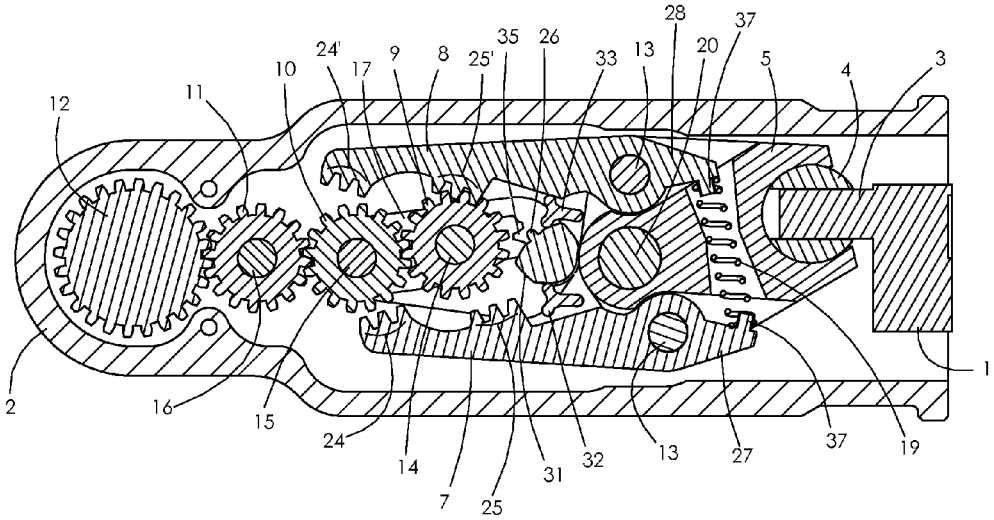
FIG. 4 is a cross-sectional view taken along line 4-4 of FIG. 3 showing the main operational components of the embodiment of FIG. 1.
Figure 5:
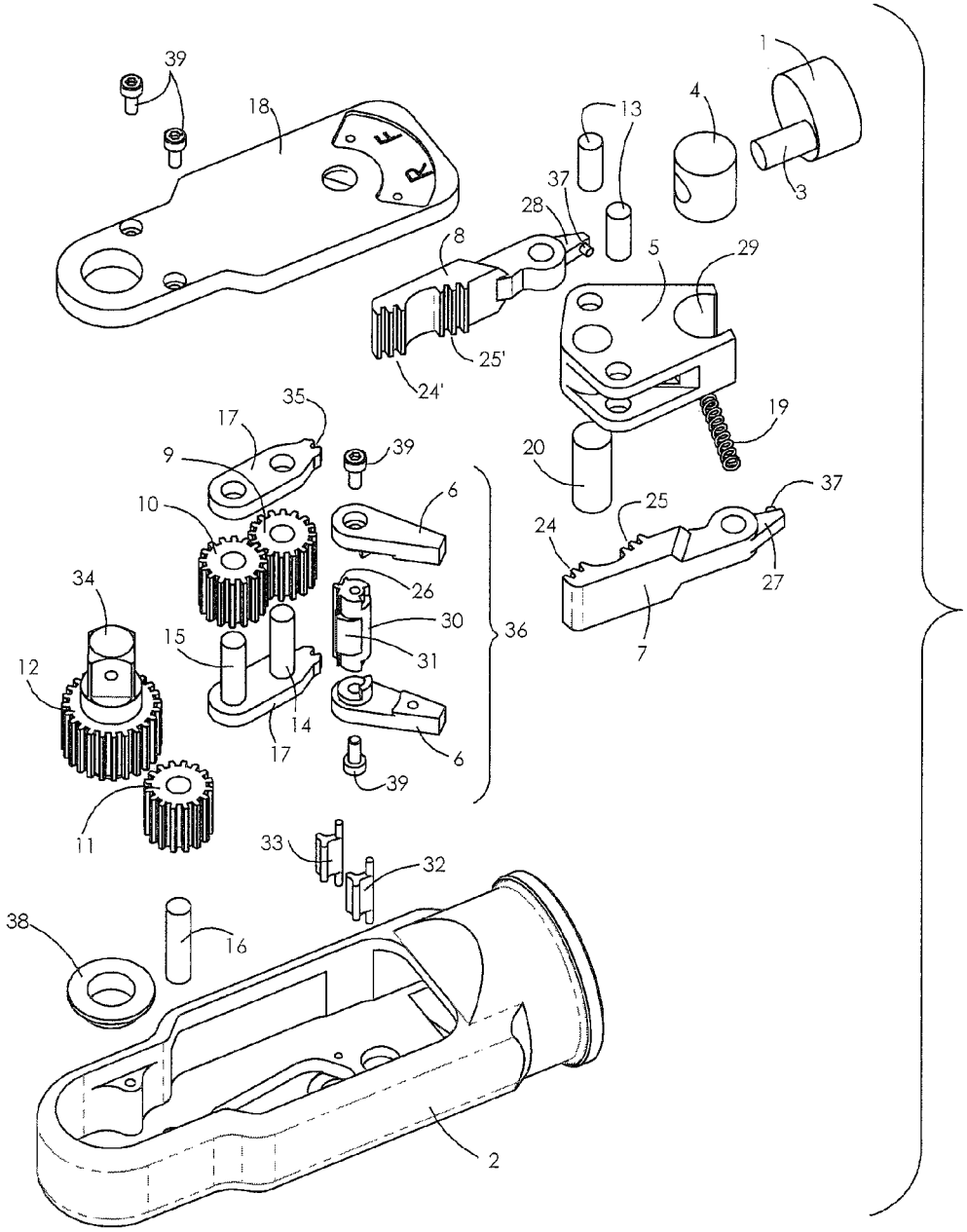
FIG. 5 is an exploded perspective view of the main operational components of the embodiment of FIG. 1.

Referring now to the drawings, general embodiments of the ratchet mechanism are seen to comprise a transmission output, a rocker, a first pawl, a second pawl, at least one intermediate drive member, a stationary drive or output member, and a housing. More preferable embodiments of the ratchet mechanism further comprise a reverse lever, a reversing cam and a reversing arm as embodiments of a mechanism to change the rotation direction of the output member, wherein one of the at least one intermediate drive members is movable relative to the first and second pawls. As used herein, the distal direction shall be taken as the direction toward the stationary drive or output member and the proximal direction shall be taken as the direction toward the transmission output. Further, the term "stationary" when used in conjunction with "drive member" or "output member" shall refer herein to the construction wherein the longitudinal rotation axis of the stationary drive member is in a fixed and non-moving position relative to the housing. The term "movable" when used in conjunction with "drive member" or "output member" shall refer herein to the construction wherein the longitudinal rotation axis of the movable drive member is movable to different locations relative to the housing.

The first and preferred embodiment of the ratchet mechanism is illustrated in FIGS. 1-7. In this embodiment, the ratchet mechanism is seen to comprise in general a transmission output 1, a transmission drive pin 3, a housing 2, a rocker pin 4, a rocker 5, a reverse lever 6, a reversing cam 26, a first pawl 7, a second pawl 8, a movable intermediate drive member 9, a first stationary intermediate drive member 10, a second stationary intermediate drive member 11, a stationary drive member or output member 12, pawl pins 13, drive member pins 14-16, a reversing arm or swing link 17, a cover plate 18, a spring 19, screws 39 and a bushing 38. The stationary drive member 12 comprises an axially-extending projection member or anvil 34, typically square in cross-section, which cooperatively mates with the receptacle of a socket or which can be used to transmit rotation to an object. The teeth on each pawl 7 and 8 are divided into a distal toothed engagement section 24 and 24' and a proximal toothed engagement section 25 and 25', respectively, which may be separate and distinct segments or which may be combined into a single linear or curved configuration.

The transmission output 1 is caused to rotate by a motor of some type (such as for example a pneumatic, hydraulic, electric or fueled motor). The transmission drive pin 3 is caused to rotate eccentrically about the axis of rotation of the transmission output 1. The transmission drive pin 3 in turn causes a circular oscillating motion of the rocker pin 4. The rocker pin 4 is constrained within the rocker access 29 of the rocker 5 such that as the rocker pin 4 oscillates the rocker 5 pivots about an axis through the rocker pivot pin 20. In the embodiment as shown the rocker 5 is restrained to the housing 2 by the rocker pivot pin 20. The resulting interaction of these components cause a full pivoting oscillation of rocker 5 for a single full revolution of the transmission output 1.

The pivoting motion of the rocker 5 results in alternating movement of the first and second pawls 7 and 8, such that with first pawl 7 moving in the distal direction the second pawl 8 is moving in the proximal direction, and vice versa. As explained further below, one movement direction is the engaged or driving direction of a given pawl 7 or 8 wherein, in this embodiment, the teeth of pawl 7 or 8 are engaged with one of the drive members 9 or 10 so as to impart rotation. The opposite movement direction is the disengaged or retracting direction of the pawl 7 or 8 wherein the teeth of pawl 7 or 8 are not in driving engagement with either of the drive members 9 or 10.

The movable intermediate drive member 9 engages the first stationary intermediate drive member 10, which in turn engages the second stationary intermediate drive member 11, which in turn engages the stationary drive member 12, such that rotation of the movable intermediate drive member 9 results in rotation of the stationary drive member 12 and anvil 34. Clockwise rotation of the movable intermediate drive member 9 results in counterclockwise rotation of the stationary drive member 12 and anvil 34. Conversely, counterclockwise rotation of the movable intermediate drive member 9 results in clockwise rotation of the stationary drive member 12 and anvil 34.

Figure 6A:
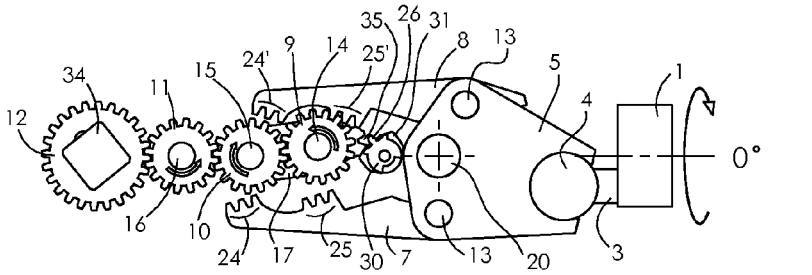
FIGS. 6*a-f* illustrate successive operational stages of the embodiment of FIG. 1.
Figure 6B:
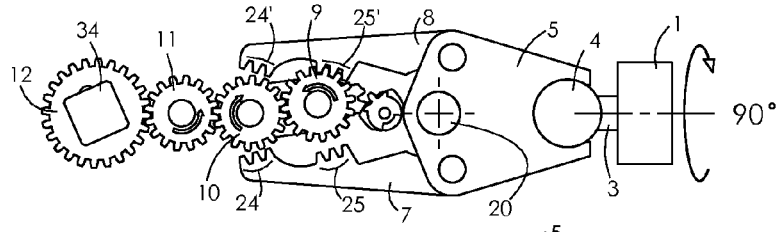
Figure 6C:
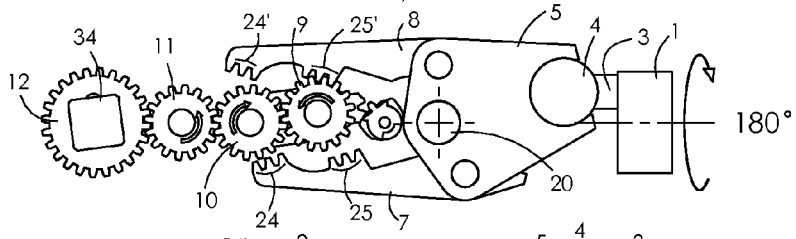

As depicted in FIGS. 6*a*-6*c* the transmission output 1 is rotated from the referenced 0 degrees to 180 degrees. The first pawl 7 is retracting in the disengaged direction (proximal for this embodiment) due to the motion of the rocker 5 and the teeth of distal toothed engagement section 24 of the first pawl 7 are disengaged from the stationary intermediate drive member 10 due to the sliding wedging action of the faces of the teeth between these members, i.e., movement of the first pawl 7 in the proximal disengaged direction imparts no rotation to the stationary intermediate drive member 10. The teeth of the proximal toothed engagement section 25 of the first pawl 7 do not contact the movable intermediate drive member 9 as the movable intermediate drive member 9 is positioned adjacent the second pawl 8 in this illustration. The second pawl 8 is caused to move in the engaged or driving direction (distal for this embodiment) generally toward the stationary drive member 12 due to the motion of the rocker 5, with the proximal toothed engagement segment 25' engaging the teeth of the movable intermediate drive member 9 to impart rotation thereto. During this motion the distal toothed engagement section 25' teeth of the second pawl 8 and the first movable intermediate drive member 9 maintain a gear-mesh type engagement such as might be seen with the well-known rack and pinion arrangement, though these teeth do not necessarily prescribe to the classical definition of gear teeth or even of a rack. The teeth of the distal toothed engagement section 24' of the second pawl 8 do not contact the stationary intermediate drive member 10. As the second pawl 8 is driven forward by the rocker 5 the movable intermediate drive member 9 is caused to rotate in a counterclockwise direction, which causes the first stationary intermediate drive member 10 to rotate in a clockwise direction, as depicted in FIGS. 6*a*-6*c*. The teeth of the first stationary intermediate drive member 10 are engaged with the teeth of the second stationary intermediate drive member 11 causing the second stationary intermediate drive member 11 to rotate in a counterclockwise direction. The teeth of the second stationary intermediate drive member 11 are engaged with the teeth of the stationary drive member 12 causing the stationary drive member 12 and anvil 34 to rotate in a clockwise direction.

Figure 6D:
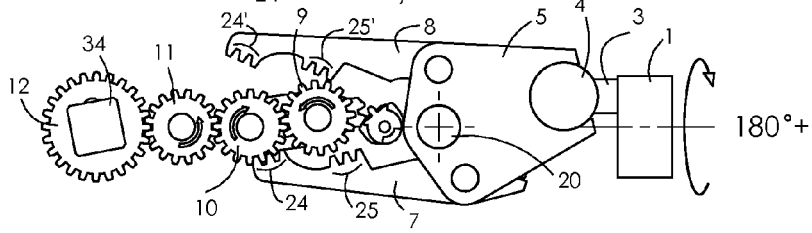
Figure 6E:
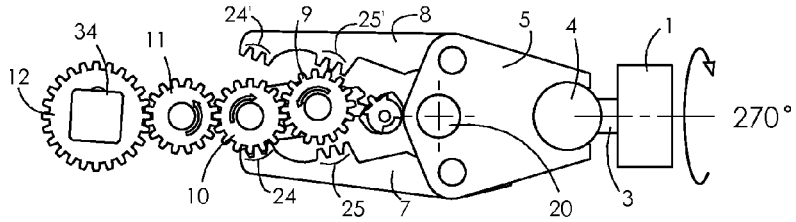
Figure 6F:
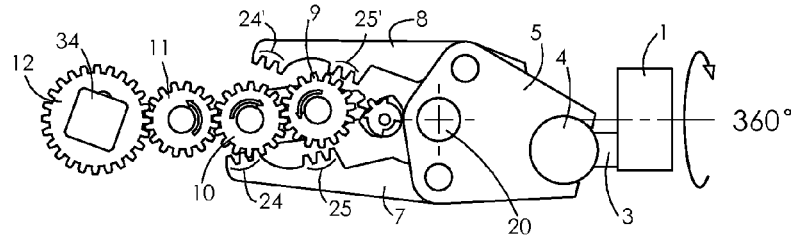

As depicted in FIGS. 6*d*-6*f* the transmission output 1 is now rotated an additional 180 degrees from the referenced 180 degrees to 360 degrees. The second pawl 8 is now retracting in the proximal direction due to the motion of the rocker 5 and the proximal toothed engagement section 25' of the second pawl 8 is disengaged from the movable intermediate drive member 9 due to the sliding wedging action of the faces of the teeth between these members. The first pawl 7 is now caused to move in the distal engaged direction generally toward the stationary drive member 12 due to the motion of the rocker 5. During this motion the distal toothed engagement section 24 teeth of the first pawl 7 and the first stationary intermediate drive member 10 maintain a gear-mesh type engagement such as might be seen with the well-known rack and pinion arrangement, though these teeth do not necessarily prescribe to the classical definition of gear teeth or even of a rack. As the first pawl 7 is driven in the engaged direction by the rocker 5 the first stationary intermediate drive member 10 is caused to rotate in a clockwise direction as depicted in FIGS. 6*d*-6*f*. The teeth of the first stationary intermediate drive member 10 are engaged with the teeth of the second stationary intermediate drive member 11, causing the second stationary intermediate drive member 11 to rotate in a counterclockwise direction. The teeth of the second stationary intermediate drive member 11 are engaged with the teeth of the stationary drive member 12, causing the stationary drive member 12 and anvil 34 to rotate in a clockwise direction. The movable intermediate drive member 9 is caused to rotate counterclockwise, but it is disengaged from pawl 8 due to the retraction of pawl 8 and the sliding wedging action of the faces of the teeth between these members.

A biasing mechanism, such as for example a spring under tension, a spring under compression, a torsion spring, magnetic attraction or the like is used to properly urge the first and second pawls 7 and 8 to re-engage their respective intermediate drive members 9 and 10 upon completion of their disengaged strokes. In the embodiment depicted in FIGS. 4 and 5, a compression spring 19 is employed to urge the first pawl 7 and the second pawl 8 into engagement with their respective intermediate drive members 10 and 9. The first pawl 7 is provided with a first pawl extension arm 27 extending in the proximal direction and the second pawl 8 is provided with a second pawl extension arm 28 also extending in the proximal direction. Spring mounting posts 37 are provided on each pawl extension arm 27 and 28 to retain spring 19. In this manner the distal ends of the first and second pawls 7 and 8 are biased inward toward the movable drive member 9 and the first stationary drive member 10.

In the preferred aspect of the present invention generally as set forth above, the ratchet further comprises a reversing mechanism 36 such that the stationary drive member 12 and anvil 34 can be driven in either the clockwise or counterclockwise direction. As shown in the figures, an embodiment of the reversing mechanism 36 assembly comprises one or preferably two user-actuated levers 6 positioned on the exterior of the housing 2 and/or cover plate 18. Most preferably the reversing lever or levers 6 are removable by the user. The reversing lever 6 is connected through the cover plate 18 and/or the housing 2 to a movable reverse lever post 30. The reverse lever post 30 comprises a spreading cam 31 and a reversing cam 26. The reversing cam 26 is received within a reverse arm notch 35 on the proximal end of the reversing arm 17. Thus the reversing cam 26 is sized and shaped to engage the reversing arm 17. The spreading cam 31 and reversing cam 26, being formed integral to the reverse lever post 30, turn with the rotation of the reverse lever post 30. The reversing arm 17 is sized and shaped to retain the movable intermediate drive member 9 and the first stationary drive member 10. The movable intermediate drive member 9 is mounted to the reversing arm 17 in such manner that it is free to rotate on its drive member pin 14. The reversing mechanism 36 is structured such that the movable intermediate drive member 9 may be reciprocated between pawls 7 and 8 such that it maintains engagement with one or the other of the pawls 7 or 8 during operation of the wrench except when the reversing cam 26 is rotated to cause the reversing arm 17 to move from one of its extremes to the other. During this repositioning of the reversing arm 17 the movable drive member 9 is temporarily disengaged from the pawls 7 and 8. The reversing mechanism 36 is sized and shaped such that actuating it causes the movable intermediate drive member 9 to engage only a single pawl 7 or 8 at any time during the repositioning.

Figure 7A:
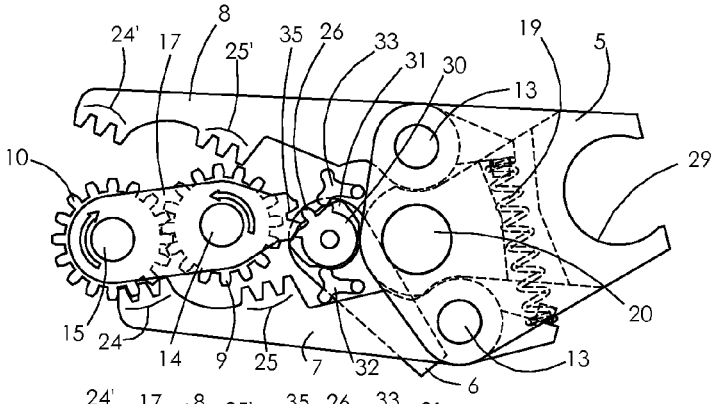
FIGS. 7*a-e* illustrate successive reversal stages of the embodiment of FIG. 1.
Figure 7B:
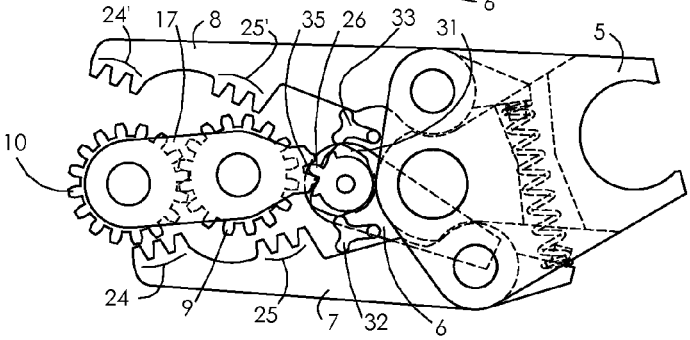
Figure 7C:
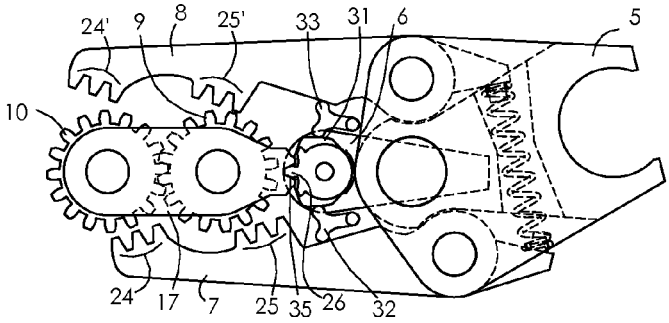
Figure 7D:
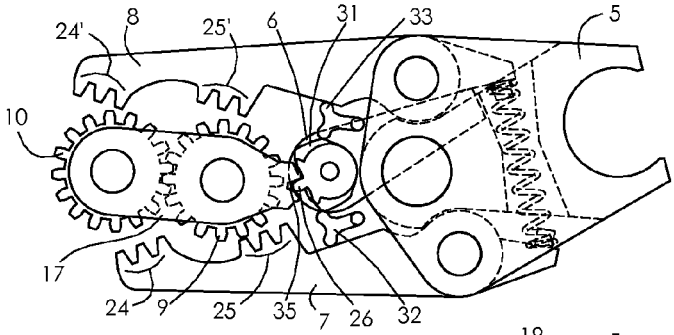
Figure 7E:
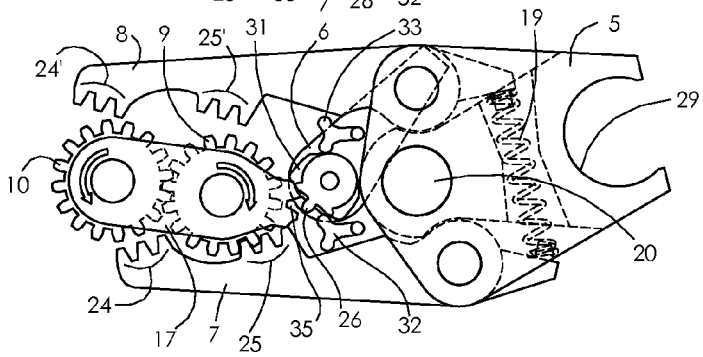

In a first position, as shown in FIGS. 6 and 7*a*, the reversing mechanism 36 causes the first pawl 7 to impart the work of its engaged (i.e., distal) motion directly to the first stationary intermediate drive member 10 and alternately causes the second pawl 8 to impart the work of its engaged motion directly to the movable intermediate drive member 9, and in a second position, as shown in FIG. 7*e*, causes the second pawl 8 to impart the work of its engaged motion directly to the first stationary intermediate drive member 10 and alternately the first pawl 7 to impart the work of its engaged distal motion directly to the movable intermediate drive member 9. In this manner the movable intermediate drive member 9 can be rotated either clockwise or counterclockwise depending on the position of the reversing arm 17, thereby allowing the stationary drive member 12 and anvil 34 to be rotated in either a counterclockwise or clockwise direction.

The reverse lever 6 is sized and shaped to fixedly connect to the reverse lever post 30 such that moving the reverse lever 6 causes the reverse lever post 30 to rotate about its axis. Rotation of the reverse lever post 30 causes the reversing cam 26 to move, which is sized and shaped to engage with the reverse arm notch 35 of the reversing arm 17, thereby causing the reversing arm 17 to change its position. The reversing arm 17 pivots on the same axis of rotation as the first stationary intermediate drive member 10, as shown in FIGS. 7*a*-*e*. The reversing arm 17 retains the movable intermediate drive member 9 and the first stationary intermediate drive member 10 via their respective drive member pins 14 and 15. As the reversing arm 17 is caused to move by the reverse lever 6 and reversing cam 26 from one position to another the movable intermediate drive member 9 is caused to also move. The movable intermediate drive member 9 maintains its toothed engagement with the first stationary intermediate drive member 10 during this repositioning. In moving from one position (FIG. 7*a*) to another (FIG. 7*e*), the reversing arm 17 causes the movable intermediate drive member to change its toothed engagement from one pawl 7 or 8 to the other. As illustrated in FIGS. 7*a*-*e*, this motion causes the pawl 7 now engaged with the first stationary intermediate drive member 10 (FIG. 7*a*) to be moved out of engagement with the first stationary intermediate drive member 10 and into engagement with the re-positioned movable intermediate drive member 9 (FIG. 7*e*). This re-positioning of the movable intermediate drive member 9 also causes pawl 8 to disengage from the movable intermediate drive member 9 (FIG. 7*a*) and to become engaged directly with and drive the first stationary intermediate drive member 10 (FIG. 7*e*) by the urging of the spring 19. Thus the direction of the stationary drive member 12 is changed by the collective changed positions of the reverse lever 6, reverse lever post 30, reversing cam 26, reversing arm 17, movable intermediate drive member 9 and the pawls 7 and 8.

In the embodiment as shown, the reversing mechanism 36 may comprise a spreading cam 31 positioned on or formed as part of reverse lever post 30. A first cam follower or pawl spreader 32 abuts a portion of the spreading cam 31 and the first pawl 7. A second cam follower or pawl spreader 33 abuts a portion of the spreading cam 31 and the second pawl 8. As shown in FIGS. 7*a*-7*e*, as the reverse lever 6 is actuated, the cam followers 32 and 33 push its respective pawl 7 or 8 outwardly to disengage the pawl 7 or 8 from the intermediate drive member 9 or 10. Most preferably, with the reverse lever 6 positioned in either of its direction selector positions each of the cam followers 32 and 33 is biased out of contact from their respective pawls 7 and 8, such as with springs or magnets, except when actuated to shift the pawls 7 or 8, in order to avoid wear during ratchet use.

Figure 8A:
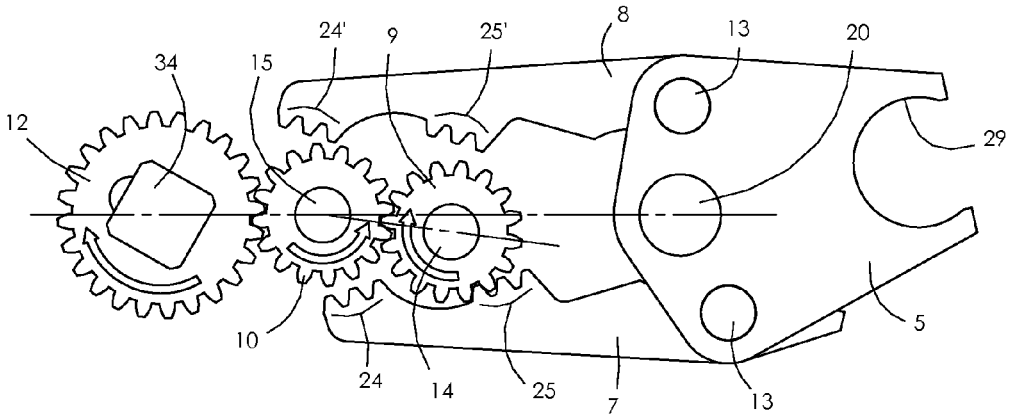
FIGS. 8*a-b* illustrate opposing reversal stages of a second embodiment of the invention, the embodiment comprising two intermediate drive members.
Figure 8B:
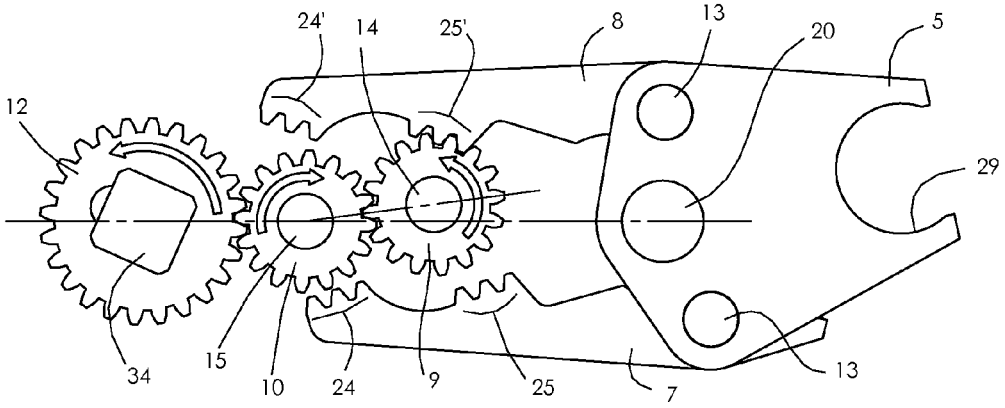
Figure 9A:
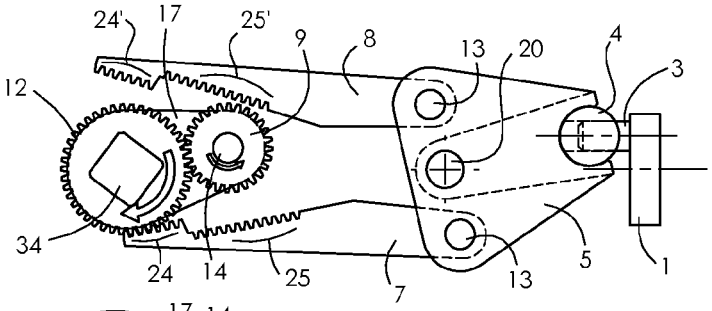
FIGS. 9*a-f* illustrate successive operational stages of a third embodiment of the invention, the embodiment comprising a single intermediate drive member.
Figure 9B:
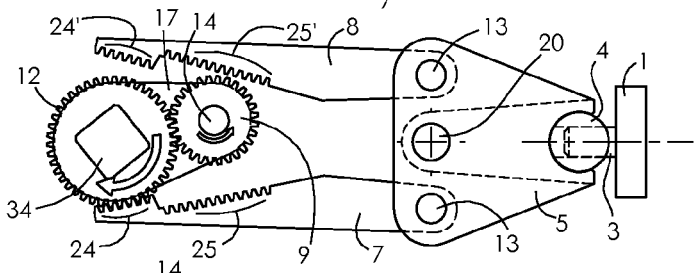
Figure 9C:
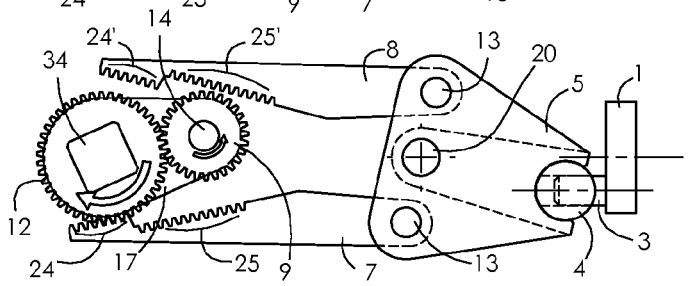
Figure 9D:
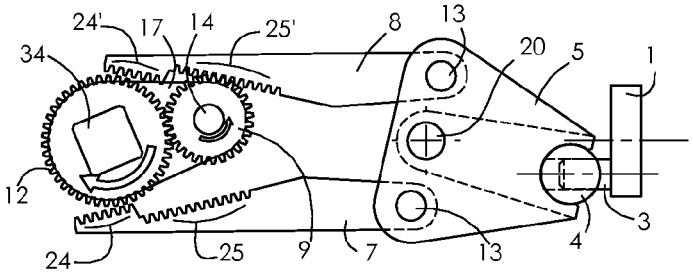
Figure 9E:
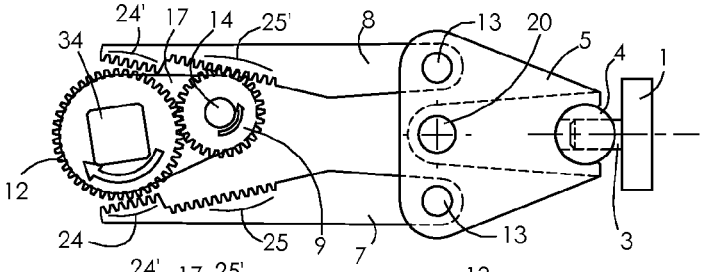
Figure 9F:
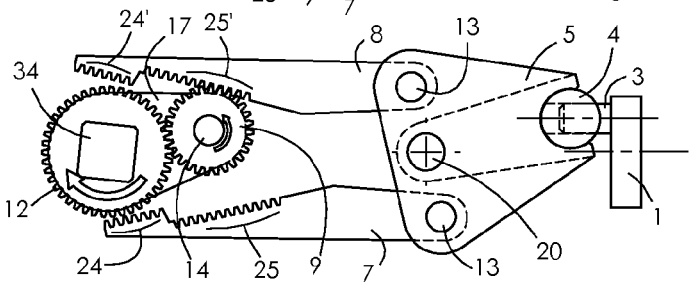

FIG. 8 illustrates a second embodiment of the ratchet mechanism. This embodiment differs from the preferred embodiment in that there is no second stationary intermediate drive member. Instead, in this embodiment the first stationary intermediate drive member 10 engages directly with stationary drive member 12, such that a clockwise rotation of the movable intermediate drive member 9 results in counterclockwise rotation of first stationary intermediate drive member 10 and clockwise rotation of the stationary drive member 12 and, with the movable intermediate drive member 9 repositioned for reversing the output, counterclockwise rotation of the movable intermediate drive member 9 results in clockwise rotation of first stationary intermediate drive member 10 and counterclockwise rotation of the stationary drive member 12. As with the preferred embodiment, reversal of the rotation direction is accomplished by re-positioning the movable intermediate drive member 9 relative to the pawls 7 and 8.

Figure 10A:
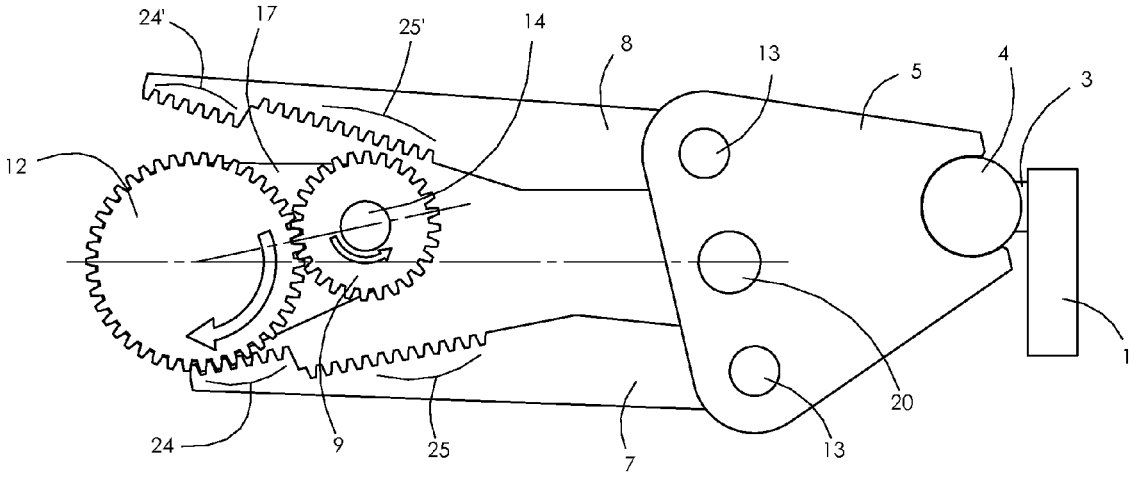
FIGS. 10*a-b* illustrate opposing reversal stages of the embodiment of FIG. 9.
Figure 10B:
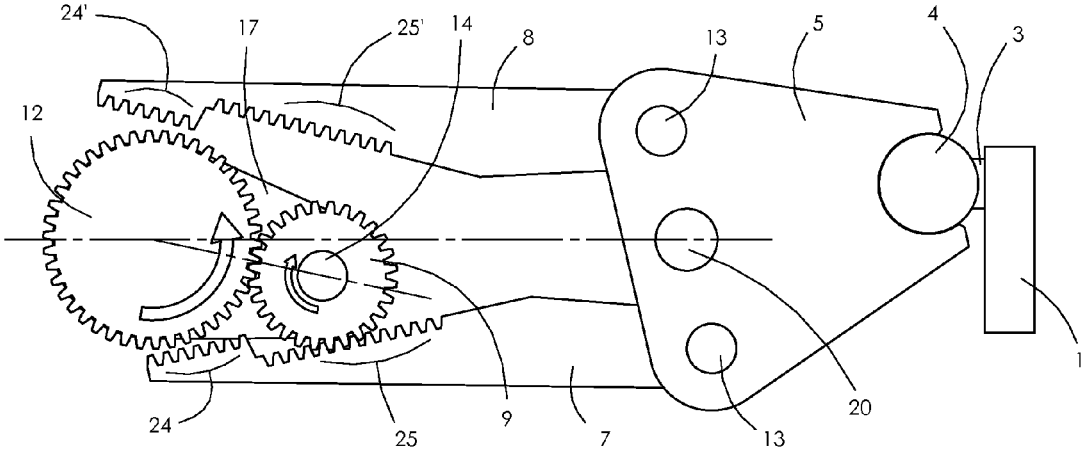

FIGS. 9 and 10 illustrate a third embodiment of the ratchet mechanism. In this embodiment there is neither a first stationary intermediate drive member nor a second stationary intermediate drive member. Instead, the movable intermediate drive member 9 engages directly with the stationary drive member 12, and the proximal toothed engagement sections 25 and 25' of the pawls 7 and 8 engage directly with the movable intermediate drive member 9 and the distal toothed engagement sections 24 and 24' engage directly with stationary drive member 12. For clockwise rotation of the stationary drive member 12 and anvil 34, as shown in FIGS. 9*a-c*, movement of the first pawl 7 in the engaged driving (distal) direction directly rotates stationary drive member 12. Movement of the second pawl 8 in the engaged driving (distal) direction, FIGS. 9*d-f*, rotates movable intermediate drive member 9 in the counterclockwise direction, which in turn rotates stationary drive member 12 in the clockwise direction. As with the preferred embodiment, during their retracting motion in the rearward or proximal direction the pawls 7 and 8 disengage from their respective drive members 9 and 12 due to the sliding wedging action of the faces of the teeth between these members. As with the preferred embodiment, reversal of the rotation direction is accomplished by re-positioning the movable intermediate drive member 9 relative to the pawls 7 and 8.

Figure 11A:
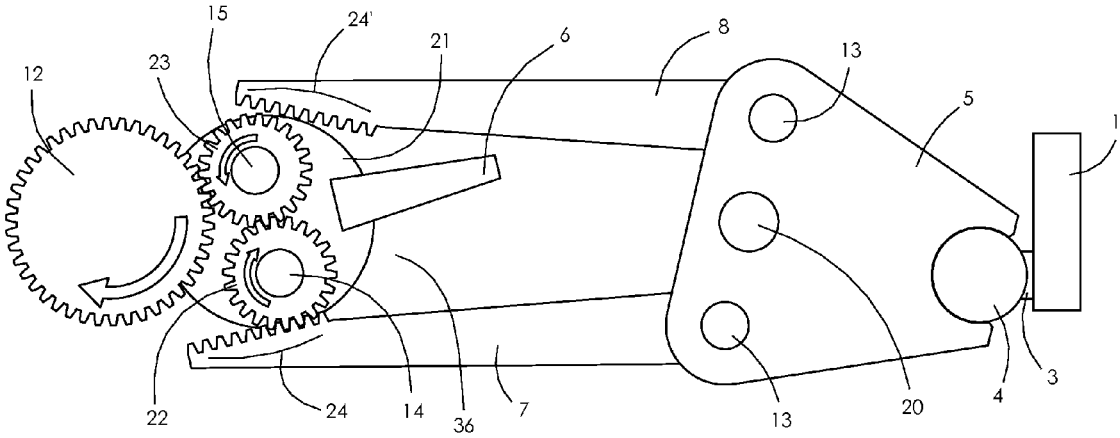
FIGS. 11*a-b* illustrate opposing reversal stages of a fourth embodiment of the invention, this embodiment comprising paired intermediate drive members.
Figure 11B:
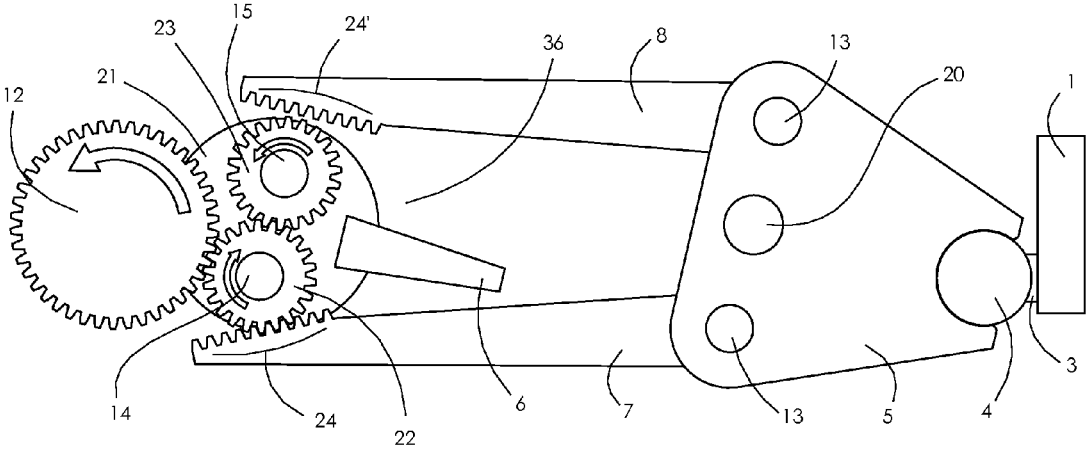

A fourth embodiment of the ratchet mechanism is shown in FIGS. 11*a-b*. In this embodiment the ratchet comprises a stationary drive member 12, a first movable intermediate drive member 22 and a second movable intermediate drive member 23, with both the paired movable intermediate drive members 22 and 23 mounted to a pivoting or rotating reverse plate 21 via their respective drive member pins 14 and 15. The first and second movable intermediate drive members 22 and 23 are always engaged with each other during the driving operation. In a first position for clockwise rotation of the stationary drive member 12, as shown in FIG. 11*a*, the distal toothed engagement section 24 of the first pawl 7 engages the first movable intermediate drive member 22 to rotate it clockwise as the first pawl 7 is extended in the distal direction. The first movable intermediate drive member 22, which is not engaged with the stationary drive member 12, turns the second movable intermediate drive member 23 counterclockwise. The second movable intermediate drive member 23 is engaged with the stationary drive member 12, such that the stationary member 12 is rotated clockwise. During the extension of pawl 7 in the distal direction pawl 8 is retracting in the proximal direction. Pawl 8 disengages from the second movable intermediate drive member 23 due to the sliding wedging action of the faces of the teeth between these members. When the rocker 5 transitions to advance the second pawl 8 and its distal toothed engagement section 24' in the distal direction, the second paired movable intermediate drive member 23 is rotated counterclockwise, thereby again rotating the stationary drive member 12 clockwise. During the extension of pawl 8 in the distal direction pawl 7 is retracting in the proximal direction. Pawl 7 disengages from the first paired movable intermediate drive member 22 due to the sliding wedging action of the faces of the teeth between these members.

To reverse this ratchet embodiment such that the stationary drive member 12 rotates counterclockwise, the reverse plate 21 of the reversing mechanism 36 is pivoted such that the second movable intermediate drive member 23 is disengaged from the stationary drive member 12 and the first movable intermediate drive member 22 is engaged with the stationary drive member 12, as shown in FIG. 11*b*. In this configuration, extension of the first pawl 7 in the distal direction rotates the first movable intermediate drive member 22 in the clockwise direction, thereby turning the stationary drive member 12 in the counterclockwise direction. When the rocker 5 transitions to advance the second pawl 8 in the distal direction, the second movable intermediate drive member 23 is rotated counterclockwise, thereby rotating the first movable intermediate drive member 22 clockwise to again rotate the stationary drive member 12 counterclockwise.

Thus in all embodiments the present invention with two pawls 7 and 8 converts the full oscillation of the rocker 5 into the desired output motion of the stationary drive member 12 and anvil 34 with no lag period, such that the output is doubled over known systems. In known systems, rotation of the stationary drive member occurs only during engaged movement of a single pawl in one direction, such as for example during extension. When the pawl is being retracted, no driving force is applied to the stationary drive member and as such it is non-rotating and idle. The ratchet of the present invention provides for continuous rotation of the stationary drive member 12 and anvil 34.

It is to be understood that each of the embodiments discussed above would be operational without the reversing mechanism 36, such that the ratchet would have continuous rotation but only in either a clockwise or counterclockwise direction.

In the embodiments thus far described the pawls transmit motion (work) to the output member by alternately pushing on their respective drive members through a toothed engagement during the driving movement in the distal direction. The pawls then slip out of engagement during the retracting portion of their stroke. With appropriate arrangement of components and shaping of the teeth of these pawls and drive members the mechanism can conversely be reversed to transmit motion to the stationary drive member with the pawls rotating their respective drive members during movement in the proximal direction and subsequently disengaging during movement in the distal direction. It is thus to be understood that embodiments similar to those set forth in detail above but with the pawls pulling on their respective drive members are further embodiments of this invention.

In the embodiments thus far described the pawls are caused to reciprocate in a more-or-less linear nature. It is foreseen that the reciprocation of the pawls may also be affected with a more convoluted motion. It is further foreseen that the pawls may be driven in a vast array of methods other than the rocker described within. It is thus to be understood that embodiments similar to those set forth in detail above but with the pawls caused to reciprocate with other motion profiles and via methods other than a rocker are further embodiments of this invention.

It is contemplated that equivalents and substitutions for certain elements set forth above may be obvious to those skilled in the art, and therefore the true scope and definition of the invention is to be as set forth in the following claims.

I claim:

1. A ratchet mechanism comprising:

a plurality of rotating drive members having teeth, one of the drive members being a stationary drive member having a fixed rotational axis and another of the drive members being a movable intermediate drive member, said movable intermediate drive member being engaged directly or indirectly with said stationary drive member such that rotation of said movable intermediate drive member rotates said stationary member;

said stationary drive member comprising an anvil adapted to impart rotational force to another object;

a first pawl member having teeth, said first pawl member being movable in a reciprocating manner in a first direction and a second direction, wherein during movement of said first pawl member in a first direction said first pawl member is engaged with one of said rotating drive members and rotates said stationary drive member in a first rotational direction; and a second pawl member having teeth, said second pawl member movable in a reciprocating manner in said first direction and said second direction alternating with said first pawl member, such that with said first pawl moving in said first direction said second pawl is moving in said second direction and with said first pawl moving in said second direction said second pawl is moving in said first direction, wherein during movement of said second pawl member in said first direction said second pawl member is engaged with another of said rotating drive members and rotates said stationary drive member in said first rotational direction.

2. The ratchet mechanism of claim 1, wherein said movable intermediate drive member is engaged directly with said stationary drive member, and wherein said first pawl member is engaged with said movable intermediate drive member and said second pawl member is engaged with said stationary drive member when rotating said stationary drive member in said first rotational direction.

3. The ratchet mechanism of claim 2, wherein during movement of said first pawl member in said second direction said first pawl member is disengaged from said movable intermediate drive member so as not to rotate said movable intermediate drive member; and wherein during movement of said second pawl member in said second direction said second pawl member is disengaged from said stationary drive member so as not to rotate said stationary drive member.

4. The ratchet mechanism of claim 3, further comprising a reversing mechanism adapted to move said movable intermediate drive member to a position wherein during movement of said first pawl member in said first direction said first pawl member is engaged with said stationary drive member and rotates said stationary drive member in a second rotational direction, and wherein during movement of said second pawl member in said first direction said second pawl member is engaged with said movable intermediate drive member and rotates said stationary drive member in said second rotational direction.

5. The ratchet mechanism of claim 2, further comprising a reversing mechanism adapted to move said movable intermediate drive member to a position wherein during movement of said first pawl member in said first direction said first pawl member is engaged with said stationary drive member and rotates said stationary drive member in a second rotational direction, and wherein during movement of said second pawl member in said first direction said second pawl member is engaged with said movable intermediate drive member and rotates said stationary drive member in said second rotational direction.

6. The ratchet mechanism of claim 5, said reversing mechanism comprising at least one removable reversing lever.

7. The ratchet mechanism of claim 1, wherein said plurality of rotating drive members further comprises a first stationary intermediate drive member, wherein said first stationary intermediate drive member is disposed between said stationary drive member and said movable intermediate drive member such that said movable intermediate drive member is engaged directly with said first stationary intermediate drive member and said first stationary intermediate drive member is engaged directly with said stationary drive member; and wherein said first pawl member is engaged with said movable intermediate drive member and said second pawl member is engaged with said first stationary intermediate drive member when rotating said stationary drive member in said first rotational direction.

8. The ratchet mechanism of claim 7, wherein during movement of said first pawl member in said second direction said first pawl member is disengaged from said movable intermediate drive member so as not to rotate said movable intermediate drive member; and wherein during movement of said second pawl member in said second direction said second pawl member is disengaged from said first stationary intermediate drive member so as not to rotate said first stationary intermediate drive member.

9. The ratchet mechanism of claim 8, further comprising a reversing mechanism adapted to move said movable intermediate drive member to a position wherein during movement of said first pawl member in said first direction said first pawl member is engaged with said first stationary intermediate drive member and rotates said stationary drive member in a second rotational direction, and wherein during movement of said second pawl member in said first direction said second pawl member is engaged with said movable intermediate drive member and rotates said stationary drive member in said second rotational direction.

10. The ratchet mechanism of claim 7, further comprising a reversing mechanism adapted to move said movable intermediate drive member to a position wherein during movement of said first pawl member in said first direction said first pawl member is engaged with said first stationary intermediate drive member and rotates said stationary drive member in a second rotational direction, and wherein during movement of said second pawl member in said first direction said second pawl member is engaged with said movable intermediate drive member and rotates said stationary drive member in said second rotational direction.

11. The ratchet mechanism of claim 10, said reversing mechanism comprising at least one removable reversing lever.

12. The ratchet mechanism of claim 1, wherein said plurality of rotating drive members further comprises a first stationary intermediate drive member and a second stationary intermediate drive member, wherein said first stationary intermediate drive member is disposed between said movable intermediate drive member and said second stationary intermediate drive member such that said movable intermediate drive member is engaged directly with said first stationary intermediate drive member and said first stationary intermediate drive member is engaged directly with said second stationary intermediate drive member; and wherein said second stationary intermediate drive member is disposed between said first stationary intermediate drive member and said stationary drive member such that said first stationary intermediate drive member is engaged directly with said second stationary intermediate drive member and said second stationary intermediate drive member is engaged directly with said stationary drive member; and wherein said first pawl member is engaged with said movable intermediate drive member and said second pawl member is engaged with said first stationary intermediate drive member when rotating said stationary drive member in said first rotational direction.

13. The ratchet mechanism of claim 12, wherein during movement of said first pawl member in said second direction said first pawl member is disengaged from said movable intermediate drive member so as not to rotate said movable intermediate drive member; and wherein during movement of said second pawl member in said second direction said second pawl member is disengaged from said first stationary intermediate drive member so as not to rotate said first stationary intermediate drive member.

14. The ratchet mechanism of claim 13, further comprising a reversing mechanism adapted to move said movable intermediate drive member to a position wherein during movement of said first pawl member in said first direction said first pawl member is engaged with said first stationary intermediate drive member and rotates said stationary drive member in a second rotational direction, and wherein during movement of said second pawl member in said first direction said second pawl member is engaged with said movable intermediate drive member and rotates said stationary drive member in said second rotational direction.

15. The ratchet mechanism of claim 12, further comprising a reversing mechanism adapted to move said movable intermediate drive member to a position wherein during movement of said first pawl member in said first direction said first pawl member is engaged with said first stationary intermediate drive member and rotates said stationary drive member in a second rotational direction, and wherein during movement of said second pawl member in said first direction said second pawl member is engaged with said movable intermediate drive member and rotates said stationary drive member in said second rotational direction.

16. The ratchet mechanism of claim 15, said reversing mechanism comprising at least one removable reversing lever.

17. The ratchet mechanism of claim 1, wherein during movement of said first pawl member in said second direction said first pawl member is disengaged from said one of said rotating drive members so as not to rotate said one of said rotating drive members; and wherein during movement of said second pawl member in said second direction said second pawl member is disengaged from said another of said rotating drive members so as not to rotate said another of said rotating drive members.

18. The ratchet mechanism of claim 17, further comprising a reversing mechanism adapted to move said one of said rotating drive members to a position wherein during movement of said first pawl member in said first direction said first pawl member is engaged with said another of said rotating drive members and rotates said stationary drive member in a second rotational direction, and wherein during movement of said second pawl member in said first direction said second pawl member is engaged with said one of said rotating drive members and rotates said stationary drive member in said second rotational direction.

19. The ratchet mechanism of claim 1, further comprising a reversing mechanism adapted to move said one of said rotating drive members to a position wherein during movement of said first pawl member in said first direction said first pawl member is engaged with said another of said rotating drive members and rotates said stationary drive member in a second rotational direction, and wherein during movement of said second pawl member in said first direction said second pawl member is engaged with said one of said rotating drive members and rotates said stationary drive member in said second rotational direction.

20. The ratchet mechanism of claim 19, said reversing mechanism comprising at least one removable reversing lever.

* * * * *